US005924909A

United States Patent [19]

Yamakawa

[11] Patent Number: 5,924,909

[45] Date of Patent: Jul. 20, 1999

[54] SELF-PROPELLING ROLLING TOY

[75] Inventor: Kazumi Yamakawa, Soka, Japan

[73] Assignee: Dah Yang Toy Industrial Co., Ltd, Tainan, Taiwan

[21] Appl. No.: 09/001,161

[22] Filed: Dec. 30, 1997

[51] Int. Cl.[6] ..... A63H 17/40; A63H 29/24

[52] U.S. Cl. ..... 446/442; 446/463; 446/462

[58] Field of Search ..... 446/457, 458, 446/441, 442, 462, 463

[56] References Cited

U.S. PATENT DOCUMENTS

| | | | |
|---|---|---|---|
| 118,977 | 9/1871 | Sellers | 446/458 |
| 508,558 | 11/1893 | Tate | 446/458 |
| 576,906 | 2/1897 | Sjoberg | 446/458 |
| 676,297 | 6/1901 | Balding et al. | 446/458 |
| 898,334 | 9/1908 | Day | 446/458 |
| 1,033,077 | 7/1912 | Ayers, Jr. | 446/458 |
| 1,263,262 | 4/1918 | McFaul | 446/458 |
| 1,577,997 | 10/1926 | Alk | 446/458 |
| 1,587,739 | 10/1926 | Williams | 446/458 |
| 2,137,272 | 11/1938 | Dinkel | 446/458 |
| 2,939,246 | 6/1960 | Glos, II | 446/462 |
| 2,949,697 | 8/1960 | Licitis et al. | 446/458 |
| 3,798,835 | 3/1974 | McKeehan | 446/442 |
| 4,726,800 | 2/1988 | Kobayashi | 446/458 |
| 5,297,981 | 3/1994 | Maxim et al. | 446/437 |
| 5,439,408 | 8/1995 | Wilkinson | 446/409 |
| 5,533,920 | 7/1996 | Arad et al. | 446/409 |
| 5,533,921 | 7/1996 | Wilkinson | 446/409 |
| 5,676,582 | 10/1997 | Lin | 446/130 |
| 5,692,946 | 12/1997 | Ku | 446/456 |

FOREIGN PATENT DOCUMENTS

| | | | |
|---|---|---|---|
| 1056986 | 11/1954 | Germany | 446/457 |
| 1008490 | 10/1965 | United Kingdom | 446/457 |

*Primary Examiner*—Robert A. Hafer
*Assistant Examiner*—Michael B. Priddy
*Attorney, Agent, or Firm*—Darby & Darby

[57] ABSTRACT

A self-propelling rolling toy includes a transparent spherical outer casing, a coupling rod provided in and coupled non-rotatably to the outer casing, a horizontal transmission shaft mounted rotatably in the outer casing, an inner body mounted rotatably on the shaft inside the outer casing, a clutch operable to lock selectively the inner body to the outer casing, and a winding-type driving unit disposed in the inner body. The driving unit includes a spiral energy spring with an innermost end coupled to the shaft and an outermost end coupled to the inner body, a ratchet and pawl unit provided on the shaft, and a gear set which couples the ratchet and pawl unit and the coupling rod. The ratchet and pawl unit prevents rotation of the shaft from being transmitted to the coupling rod when the shaft is rotated in a first direction while the inner body is locked to the outer casing to permit winding of the spring, and permits rotation of the shaft in an opposite second direction due to operating energy stored in the spring to be transferred to the outer casing while the inner body is unlocked from the outer casing.

8 Claims, 6 Drawing Sheets

SELF-PROPELLING ROLLING TOY

BACKGROUND OF THE INVENTION

1. Field of the Invention

The present invention relates to a self-propelling rolling toy, more particularly to a toy which has an inner body that is suspended in a transparent spherical outer casing, that is kept in a substantially upright orientation when the outer casing rolls on a ground surface, and that is rotated within the outer casing when rolling of the outer casing is resisted.

2. Description of the Related Art

A conventional self-propelling toy is usually provided with a transmission mechanism which includes a spiral torsion spring, a rotary operating member for winding the spiral torsion spring in order to store operating energy, and a gear set for transmitting the operating energy to moving parts, such as leg members, of the toy. The moving parts of the toy can thus be driven by the operating energy to move on a ground surface, such as to simulate a walking action. However, after being popular for years, the aforementioned walking-type toy has lost its appeal and has become less attractive to consumers.

SUMMARY OF THE INVENTION

The main object of the present invention is to provide a toy having an inner body suspended rotatably in a transparent spherical outer casing which is capable of rolling movement on a ground surface, whereby resistance to rotation of the outer casing results in rotation of the inner body relative to the outer casing.

Accordingly, the self-propelling rolling toy of the present invention includes a transparent spherical outer casing, a coupling rod, a horizontal transmission shaft, an inner body, clutch means and a winding-type driving unit. The coupling rod is provided in and is coupled non-rotatably to the outer casing. The horizontal transmission shaft is mounted rotatably in the outer casing along an axis of the outer casing. The transmission shaft has an operating end that extends out of the outer casing. The inner body is mounted rotatably on the transmission shaft inside the outer casing. The clutch means is provided on the inner body and the outer casing, and is operable to lock selectively the inner body to the outer casing. The winding-type driving unit is disposed in the inner body and includes a spiral energy spring which has an innermost end coupled to the transmission shaft and an outermost end coupled to the inner body, a ratchet and pawl unit provided on the transmission shaft, and a gear set which couples the ratchet and pawl unit and the coupling rod. The ratchet and pawl unit prevents rotation of the transmission shaft from being transmitted to the coupling rod when the operating end of the transmission shaft is rotated in a first direction while the clutch means locks the inner body to the outer casing to permit winding of the spiral energy spring for storing operating energy. The ratchet and pawl unit permits rotation of the transmission shaft in a second direction opposite to the first direction due to the operating energy of the spiral energy spring to be transferred to the outer casing via the gear set and the coupling rod to result in rotation of the outer casing relative to the inner body and in rolling movement of the outer casing when the outer casing is placed on a ground surface while the clutch means unlocks the inner body from the outer casing. Resistance to rotation of the outer casing relative to the inner body while the clutch means unlocks the inner body from the outer casing results in rotation of the inner body in the outer casing about the transmission shaft due to the operating energy of the spiral energy spring.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
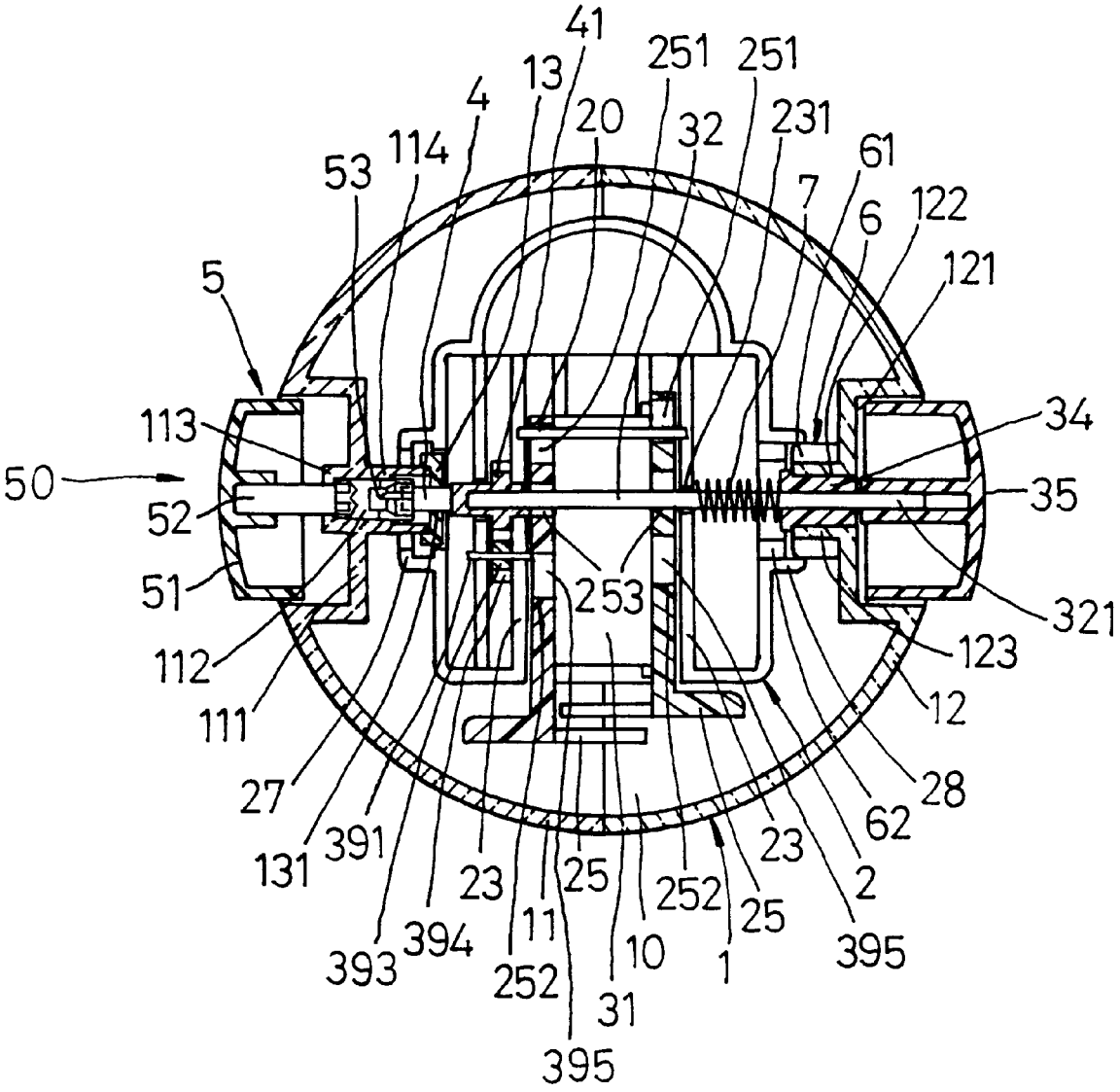
FIG. 1 is a vertical sectional view of a preferred embodiment of a self-propelling rolling toy according to the present invention.
Figure 2:
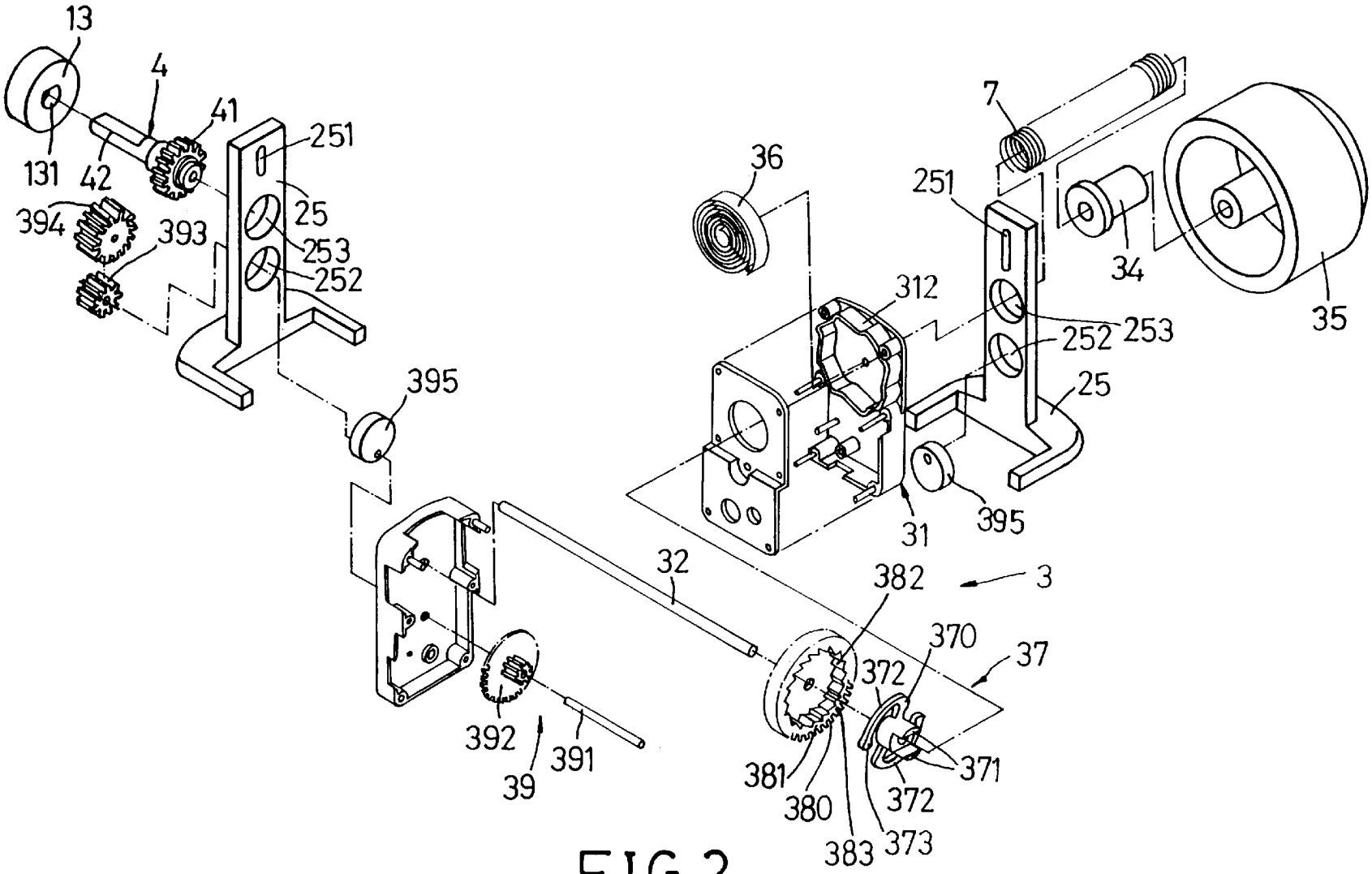
FIG. 2 is a partly exploded perspective view of the preferred embodiment, in which an outer casing and an inner body is omitted therefrom.

Referring to FIGS. 1 and 2, the preferred embodiment of a self-propelling rolling toy according to the present invention is shown to include a transparent spherical outer casing 1, an inner body 2, a coupling rod 4, a horizontal transmission shaft 32, clutch means 5 and a winding type driving unit 3.

The transparent spherical outer casing 1 includes complementary, generally semi-spherical first and second casing parts 11, 12 which cooperatively confine an interior space 10 therebetween. The first casing part 11 has a central indention 111 which is formed with a first tubular insert 114 that extends radially and that confines an axial hole 112. The first tubular insert 114 has an outer end that is formed with an inward flange 113, and an inner end that extends into the interior space 10 of the outer casing 1. The inner end of the tubular insert 114 is provided with a cap 13 that is mounted fixedly therein. The cap 13 is formed with a non-circular coupling hole 131. The second casing part 12 also has a central indention 121 which is formed with a second tubular insert 123 that is coaxial with the first tubular insert 114 and that extends radially and inwardly into the interior space 10 of the outer casing 1. The second tubular insert 123 confines an axial hole 122 which is aligned with the axial hole 112 of the first tubular insert 114.

The inner body 2 includes complementary front and rear body parts 21, 22 (see FIG. 3) and has an appearance in the form of an animal, such as a penguin. The inner body 2 is formed with a spaced pair of fixed walls 23 therein. Each of the fixed walls 23 is formed with a mounting hole 231 aligned with the axial holes 112, 122 of the outer casing 1. The inner body 2 is provided with a spaced pair of leg members 25 between the fixed walls 23. Each of the leg members 25 is formed with an upper vertically extending retaining slot 251, a lower cam engaging hole 252, and a mounting hole 253 between the retaining slot 251 and the cam engaging hole 252. A retaining rod 20 extends between the fixed walls 23 and through the retaining slots 251 of the leg members 25 for mounting the leg members 25 to the inner body 2 while permitting upward and downward movement of the leg members 25. The inner body 2 has two opposite sides formed with first and second tubular sleeves 27, 28 which project toward the indentions 111, 121 of the outer casing 1, respectively, and which permit extension of the respective one of the first and second tubular inserts 114, 123 of the outer casing 1 thereinto.

The transmission shaft 32 is mounted rotatably in the outer casing 1 along the axis of the first and second tubular inserts 114, 123, and has an operating end 321 that extends out of the second tubular insert 123 of the outer casing 1 and that is provided with a rotary knob 35 outside the outer casing 1. The operating end 321 extends through a retaining sleeve 34 that is retained in the axial hole 122 of the second tubular insert 123. The transmission shaft 32 extends into the inner body 2 such that the inner body 2 is mounted rotatably thereon.

The winding-type driving unit 3 includes a spiral energy spring 36, a ratchet and pawl unit 37 and a gear set 39. The ratchet and pawl unit 37 includes a pawl member 370 and a ratchet wheel 380. The pawl member 370 has the transmission shaft 32 extending therethrough and mounted securely thereon. The pawl member 370 is formed with two insert legs 371 for coupling fittingly with an innermost end of the spiral energy spring 36. The pawl member 370 is further formed with two curved arms 372, each of which has a distal end formed with a pawl projection 373. The ratchet wheel 380 is disposed adjacent to the pawl member 370 and has the transmission shaft 32 extending rotatably therethrough. The ratchet wheel 380 is formed with an annular surrounding wall 381 that extends around the pawl member 370. The annular surrounding wall 381 has an inner surface formed with a plurality of ratchet teeth 382 therealong for engaging the pawl projections 373 on the pawl member 370 when the pawl member 370 is rotated in a certain direction, such as an anti-clockwise direction in FIG. 2. The annular surrounding wall 381 further has an outer surface formed with a plurality of engaging teeth 383 therealong. The spiral energy spring 36 and the ratchet and pawl unit 37 are received in a drive casing 31 that is mounted fixedly in the inner body 2 between the fixed walls 23. The spiral energy spring 36 further has an outermost end coupled to a wall 312 of the drive casing 31, thereby coupling the outermost end of the spring 36 to the inner body 2. The transmission shaft 32 extends through the spiral energy spring 36 and the ratchet and pawl unit 37 and has two opposite ends that extend out of the drive casing 31 and that extend respectively through the mounting holes 231 of the fixed walls 23 of the inner body 2. The gear set 39 includes a gear axle 391 mounted rotatably on the drive casing 31, and a coupling gear 392 mounted securely on the gear axle 391 inside the drive casing 31 and meshing with the engaging teeth 383 of the ratchet wheel 380. The gear axle 391 has two opposite ends that extend out of the drive casing 31 and that are provided with eccentric cam members 395 which engage the leg members 25 at the cam engaging holes 252, respectively. The cam members 395 are oriented in opposite directions on the gear axle 391. The left end of the gear axle 391 extends through the respective cam member 395 and the respective leg member 25, and has a first transmission gear 393 mounted securely thereon. The first transmission gear 393 meshes with a second transmission gear 394 that is mounted rotatably in the inner body 2. The first and second transmission gears 393, 394 constitute a transmission gear unit.

The coupling rod 4 is disposed in the outer casing 1 and has a coupling end section 42 with a non-circular cross-section conforming with the coupling hole 131 of the cap 13. The coupling end section 42 extends slidably through the coupling hole 131 of the cap 13 to be coupled non-rotatably to the first tubular insert 114 of the outer casing 1. The coupling rod 4 further has a drive end 41 disposed in the inner body 2 adjacent to one side of a left one of the fixed walls 23. The drive end 41 meshes with the second transmission gear 394.

The clutch means 5 includes a locking unit 6, a biasing spring 7, and a positioning unit 50. The locking unit 6 includes a plurality of external splines 61 that are formed on the second tubular insert 123 of the outer casing 1, and a plurality of internal splines 62 that are formed on the second tubular sleeve 28 for engaging the external splines 61 to lock the inner body 2 against rotation on the outer casing 1. The biasing spring 7 is sleeved on the transmission shaft 32 between the retaining sleeve 34 and a right one of the fixed walls 23. The biasing spring 7 is normally in an expanded state to push the right partition wall 23 leftward so as to bias the inner body 2 to move in a direction away from the second tubular insert 123 of the outer casing 1 for disengaging the internally splined tubular sleeve 28 from the externally splined tubular insert 123, thereby unlocking the inner body 2 from the outer casing 1.

Figure 4:
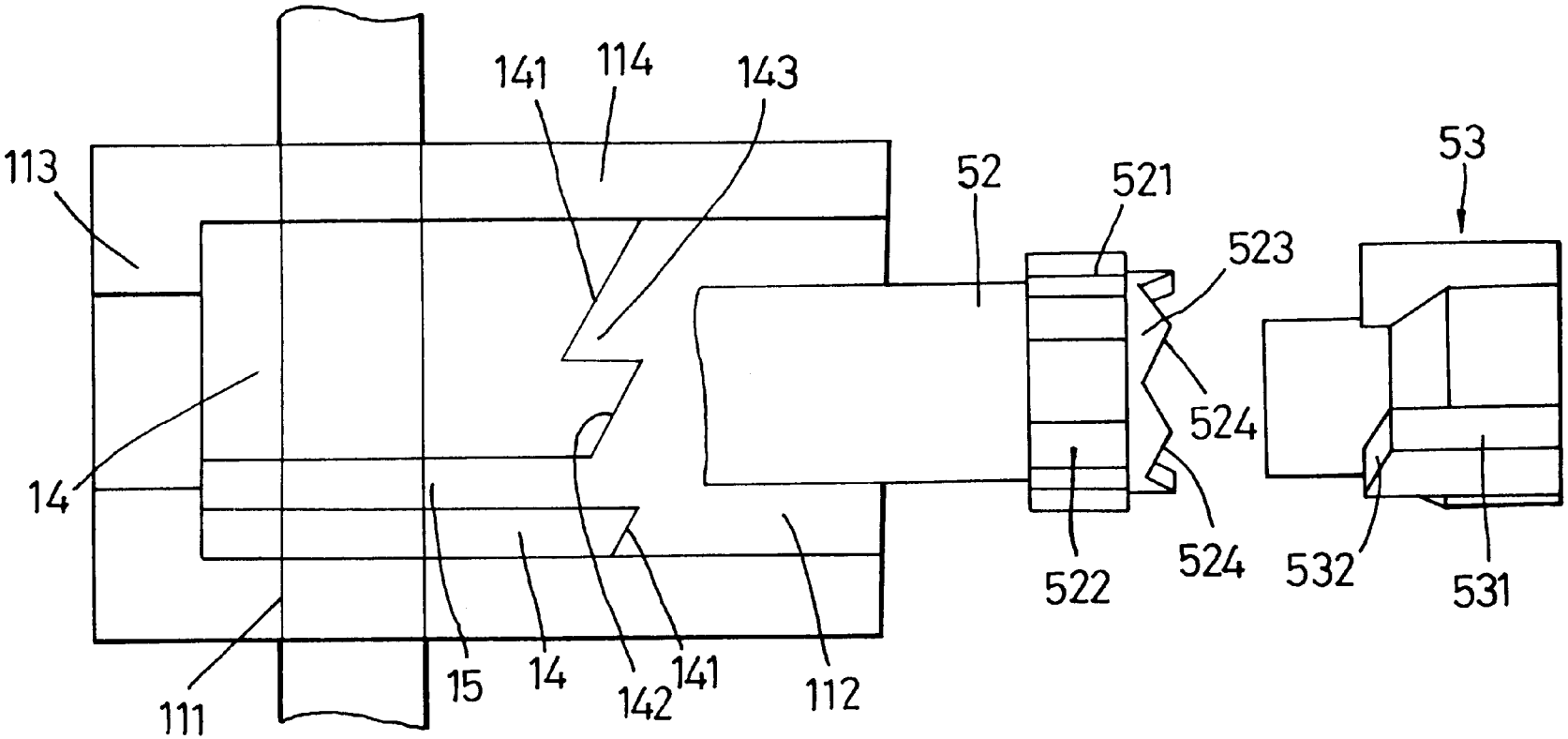
FIG. 4 illustrates a positioning unit of the toy of the preferred embodiment.

Referring to FIGS. 1 and 4, the positioning unit 50 includes a push button 51 which is mounted on the outer casing 1 at the indention 111 of the first casing part 11 and which has an actuating rod 52 that has an actuating end 521 extending into the axial hole 112 of the first tubular insert 114 and retained in the axial hole 112 by the inward flange 113, and a push member 53 slidably received in the axial hole 112 of the first tubular insert 114. The actuating end 521 of the actuating rod 52 has an outer surface formed with a plurality of axially extending ribs 522. The first tubular insert 114 has an inner surface formed with three angularly spaced guide protrusions 14. A guide groove 15 is defined between every adjacent pair of the guide protrusions 14 to permit slidable extension of the ribs 522 on the actuating end 521 of the actuating rod 52 thereinto for guiding axial movement of the actuating rod 52 relative to the first tubular insert 114. The actuating end 521 has an end face formed with a plurality of triangular guide portions 523 with inclined faces 524. The push member 53 is disposed between the actuating rod 52 and the coupling rod 4, and has an outer surface formed with three angularly-spaced, axially extending retaining protrusions 531, each of which has an inclined face 532 conforming with the inclined faces 524 on the actuating rod 52. Each of the guide protrusions 14 on the inner surface of the tubular insert 114 has a first inclined face 141 and a second inclined face 142 which conform with the inclined faces 532 on the push member 53. Each of the guide protrusions 14 has a retaining groove 143 formed between the first and second inclined faces 141, 142.

Figure 5:
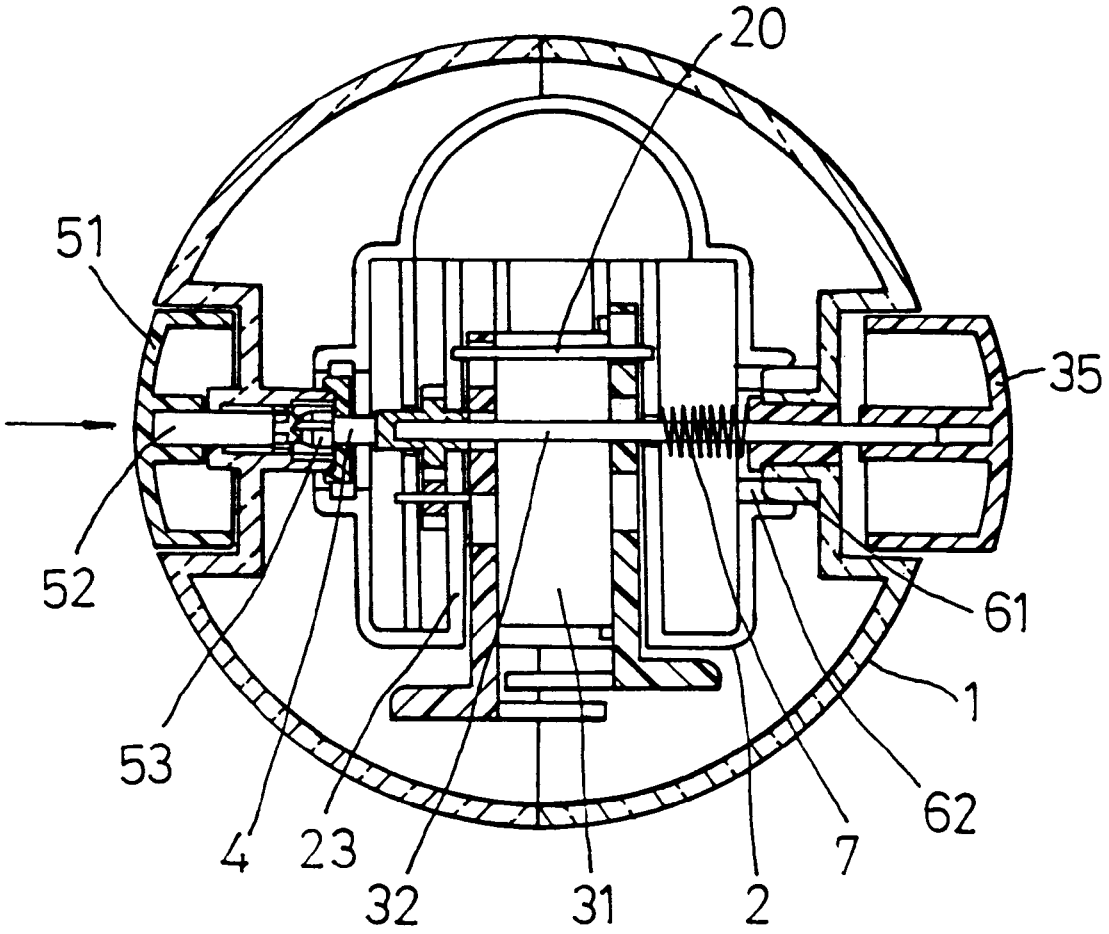
FIG. 5 is another vertical sectional view of the preferred embodiment in which a push button is pushed.

Before the push button 51 of the clutch means 5 is operated for the first time, the biasing spring 7 expands to bias the inner body 2 toward the first tubular insert 114. At this time, the push member 53 is pushed by the coupling rod 4 so that the retaining protrusions 531 of the push member 53 and the ribs 522 on the actuating end 521 of the actuating rod 52 extend into the guide grooves 15 in a releasing position where the inner body 2 is unlocked from the outer casing 1. When the push button 51 is operated for the first time, the actuating end 521 of the actuating rod 52 abuts against the inclined faces 532 of the push member 53 to push the push member 53 in a direction toward the inner body 2 against the biasing action of the biasing spring 7. Once the inclined faces 532 of the push member 53 move past upper ends of the first inclined faces 141, the inclined faces 532 slide along the first inclined faces 141 so that the retaining protrusions 531 are retained in the retaining grooves 143 for retaining the push member 53 in a pushing position, where the push member 53 pushes the coupling rod 4 and the inner body 2 against the action of the biasing spring 7 such that the internal splines 62 engage the external splines 61 for locking the inner body 2 to the outer casing 1, as shown in FIG. 5.

Figure 3:
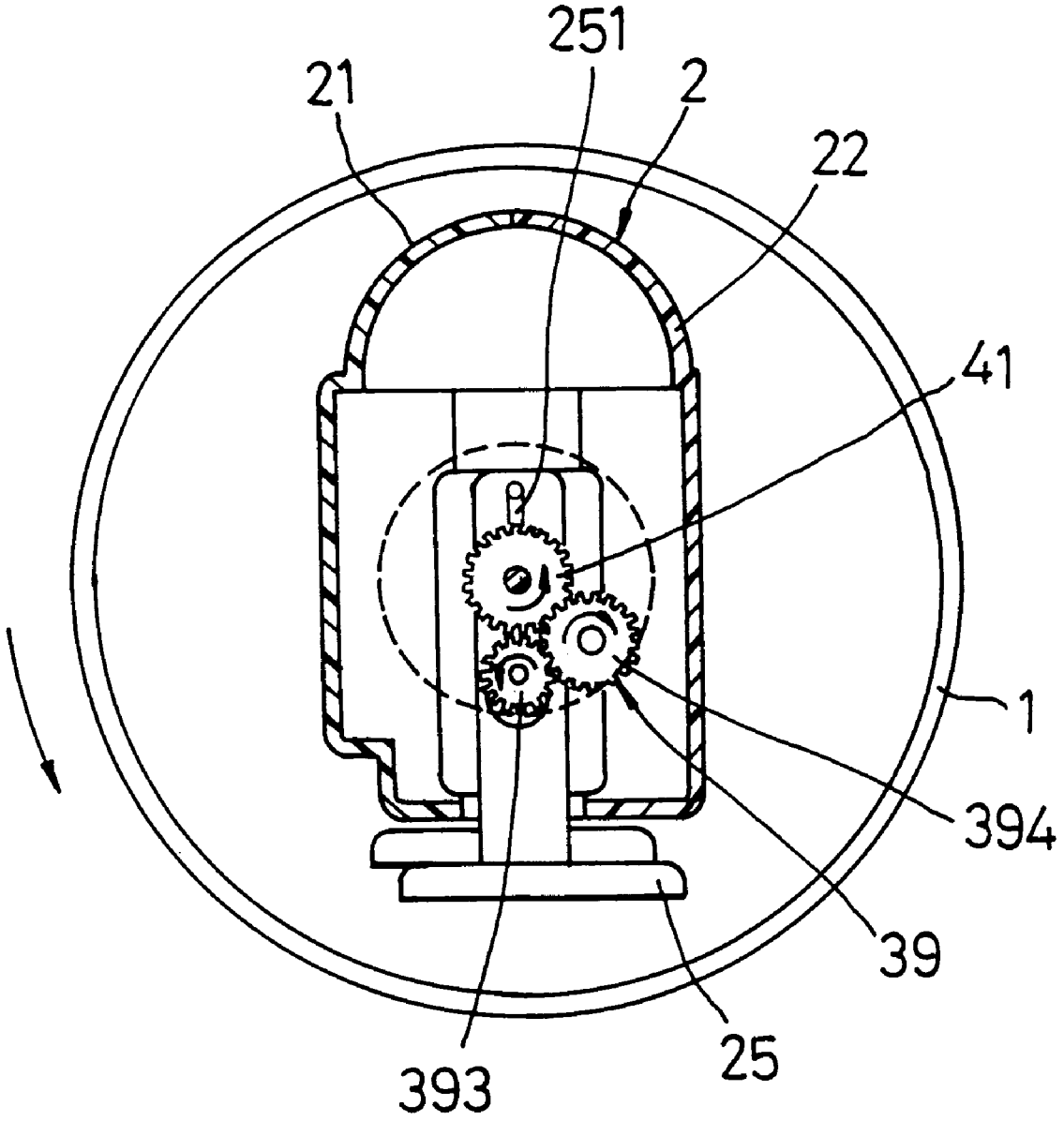
FIG. 3 is a side, vertical sectional view of the inner body of the toy of the preferred embodiment, a casing part of the outer casing being removed for the sake of clarity.
Figure 6:
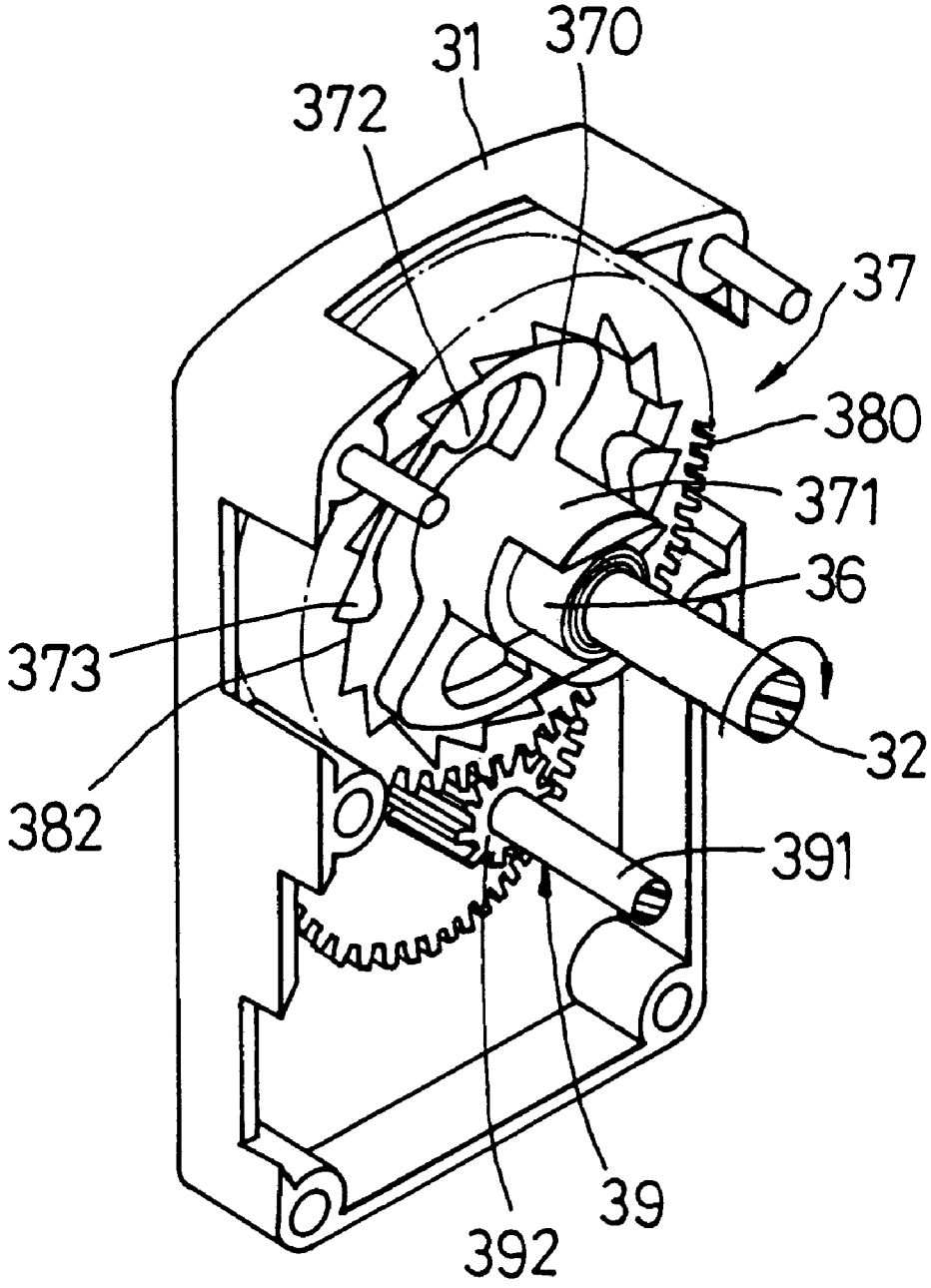
FIG. 6 illustrates how a ratchet and pawl unit and a spiral torsion spring are mounted on a transmission shaft of the preferred embodiment, only a portion of the spring being shown for the sake of clarity.

After the pushing member 53 of the clutch means 5 has been retained in the pushing position, where the inner body 2 is locked to the outer casing 1, the rotary knob 35 of the transmission shaft 32 is rotated while the outer casing 1 is held by the user. Referring to FIGS. 3, 5 and 6, when the rotary knob 35 is rotated in a first direction, such as a clockwise direction in FIG. 6 (the direction shown in FIG. 3 is opposite to that shown in FIG. 6 due to opposite points of observation), the pawl member 370 is rotated together with the transmission shaft 32 in the clockwise direction. Since the insert legs 371 of the pawl member 370 are coupled to the spiral energy spring 36 (only part of the spring 36 is shown in FIG. 6 for the sake of clarity), the spiral energy spring 36 is wound for storing operating energy at this time. Since the pawl projections 373 of the pawl member 370 do not engage the ratchet teeth 382 on the ratchet wheel 380, rotation of the transmission shaft 32 is prevented from being transmitted to the coupling rod 4 via the gear set 39. When rotation of the rotary knob 35 is stopped, the pawl projections 373 of the pawl member 370 engage the ratchet teeth 382 on the ratchet wheel 380. At this time, since the ratchet wheel 380 meshes with the gear set 39, which meshes with the coupling rod 4, that, in turn, is coupled non-rotatably to the outer casing 1, and since the outer casing 1 is held by the user, the outer casing 1, the coupling rod 4, the gear set 39 and the ratchet wheel 380 are prevented from rotation. As such, the pawl member 370 and the transmission shaft 32 mounted thereon are prevented from rotation to prevent unwinding of the spiral energy spring 36. The spiral energy spring 36 can thus be continuously wound until a sufficient amount of operating energy has been stored in the spiral energy spring 36.

Referring again to FIGS. 1 and 4, after a sufficient amount of operating energy has been stored, the push button 51 of the clutch means 5 is pushed for a second time so that the push member 53 is moved once again by the actuating rod 52 in a direction toward the inner body 2. Once the inclined faces 532 of the push member 53 move past upper ends of the second inclined faces 142, the inclined faces 532 slide along the second inclined faces 142 so that the retaining protrusions 531 of the push member 53 are once again retained in the guide grooves 15, thereby retaining the push member 53 in the releasing position, where the inner body 2 is unlocked from the outer casing 1. Referring to FIGS. 2 and 3, at this time, the stored operating energy of the spiral energy spring 36 urges the pawl member 370 to rotate in a second direction opposite to the first direction, such as in an anti-clockwise direction in FIG. 2 (clockwise direction in FIG. 3). Under this situation, the pawl projections 373 of the pawl members 370 engage the ratchet teeth 382 of the ratchet wheel 380 to cause rotation of the ratchet wheel 380, thereby causing corresponding rotation of the coupling gear 392, the gear axle 391 and the first and second transmission gears 393, 394. Since the drive end 41 of the coupling rod 4 meshes with the second transmission gear 394, and since the coupling end section 42 of the coupling rod 4 is coupled non-rotatably to the outer casing 1, which has been unlocked from the inner body 2, the coupling rod 4 is rotated together with the second gear 394 to cause corresponding rotation of the outer casing 1 relative to the inner body 2. When placed on a ground surface, the outer casing 1 is thus capable of rolling movement thereon. Since the opposite ends of the gear axle 391 are mounted with the eccentric cam members 395 that engage the leg members 25, rotation of the gear axle 391 results in alternating upward and downward movement and alternating forward and rearward movement of the leg members 25 relative to the inner body 2 to generate a simulated walking movement of the inner body 2 in the rolling outer casing 1. In practice, the inner body 2 is designed to have a sufficient weight such that the force required for rotating the inner body 2 about the transmission shaft 32 inside the outer casing 1 is substantially greater than the force required for rolling movement of the outer casing 11 on the smooth ground surface. As such, the inner body 2 can be maintained in a substantially upright orientation when the outer casing 1 rolls on a ground surface.

When an obstacle is encountered by the toy during rolling movement of the outer casing 1 on the ground surface to resist rotation of the outer casing 1, rotation of the coupling rod 4 and the gear set 39 is resisted correspondingly, thereby stopping rotation of the ratchet wheel 380. At this time, since the outermost end of the spiral energy spring 36 is coupled to the drive casing 31 that is mounted fixedly in the inner body 2, the operating energy of the spiral energy spring 36 causes the drive casing 31 to rotate about the transmission shaft 32 for unwinding the spiral energy spring 36, thereby resulting in rotation of the inner body 2 in the outer casing 1 about the transmission shaft 32. Rotation of the inner body 2 results in a change in the weight center of the inner body 2 and thus results in a change in the route of rolling movement of the outer casing 1 to enable the outer casing 1 to move away from the obstacle for continued rolling movement on the ground surface.

It should be noted that the clutch means provided on the outer casing 1 and the inner body 2 for locking selectively the inner body 2 to the outer casing 1 is not limited to the type employed in the preferred embodiment. Other types of clutch means can be employed as long as the clutch means can be operated to the outer casing 1.

With this invention thus explained, it is apparent that numerous modifications and variations can be made without departing from the scope and spirit of this invention. It is therefore intended that this invention be limited only as indicated in the appended claims.

We claim:

1. A self-propelling rolling toy comprising:

a transparent spherical outer casing;

a coupling rod provided in and coupled non-rotatably to said outer casing;

a horizontal transmission shaft mounted rotatably in said outer casing along an axis of said outer casing, said transmission shaft having an operating end that extends out of said outer casing;

an inner body mounted rotatably on said transmission shaft inside said outer casing;

clutch means provided on said inner body and said outer casing and operable to lock selectively said inner body to said outer casing; and a winding-type driving unit disposed in said inner body and including a spiral energy spring which has an innermost end coupled to said transmission shaft and an outermost end coupled to said inner body, a ratchet and pawl unit provided on said transmission shaft, and a gear set which couples said ratchet and pawl unit and said coupling rod;

said ratchet and pawl unit preventing rotation of said transmission shaft from being transmitted to said coupling rod when said operating end of said transmission shaft is rotated in a first direction while said clutch means locks said inner body to said outer casing to permit winding of said spiral energy spring for storing operating energy;

said ratchet and pawl unit permitting rotation of said transmission shaft in a second direction opposite to the first direction due to the operating energy of said spiral energy spring to be transferred to said outer casing via said gear set and said coupling rod to result in rotation of said outer casing relative to said inner body and in rolling movement of said outer casing when said outer casing is placed on a ground surface while said clutch means unlocks said inner body from said outer casing;

resistance to rotation of said outer casing relative to said inner body while said clutch means unlocks said inner body from said outer casing resulting in rotation of said inner body in said outer casing about said transmission shaft due to the operating energy of said spiral energy spring.

2. The self-propelling rolling toy as claimed in claim 1, wherein said ratchet and pawl unit includes: a pawl member mounted securely on said transmission shaft and provided with a pawl projection; and a ratchet wheel mounted rotatably on said transmission shaft adjacent to said pawl member and formed with an annular surrounding wall extending around said pawl member, said annular surrounding wall being formed with a plurality of ratchet teeth therealong for engaging said pawl projection on said pawl member when said transmission shaft rotates in the second direction, and engaging teeth for meshing with said gear set.

3. The self-propelling rolling toy as claimed in claim 2, wherein said coupling rod has a drive end formed with drive teeth, said gear set including:

a gear axle mounted rotatably in said inner body;

a coupling gear mounted securely on said gear axle inside said inner body and meshing with said engaging teeth of said ratchet wheel; and a transmission gear unit coupled to said gear axle and said drive teeth on said drive end of said coupling rod for transmitting rotation of said gear axle to said coupling rod.

4. The self-propelling rolling toy as claimed in claim 3, wherein said inner body is provided with a spaced pair of leg members that are movable upwardly and downwardly thereon, said gear axle having opposite ends provided with eccentric cam members that engage said leg members to result in alternating upward and downward movement of said leg members relative to said inner body when said gear axle rotates.

5. The self-propelling rolling toy as claimed in claim 1, wherein said clutch means includes:

a locking unit provided on said inner body and said outer casing for locking releasably said inner body to said outer casing;

a biasing spring provided in said outer casing for biasing said inner body such that said locking unit normally unlocks said inner body from said outer casing; and a positioning unit mounted on and extending into said outer casing, said positioning unit being operable to push said inner body against action of said biasing spring to enable said locking unit to lock said inner body to said outer casing, and to permit expansion of said biasing spring such that said locking unit unlocks said inner body from said outer casing.

6. The self-propelling rolling toy as claimed in claim 5, wherein said locking unit includes an externally splined tubular insert extending inwardly and radially from said outer casing, and an internally splined tubular sleeve mounted on one side of said inner body, said tubular insert engaging said tubular sleeve to lock said inner body to said outer casing, said tubular insert disengaging said tubular sleeve to unlock said inner body from said outer casing.

7. The self-propelling rolling toy as claimed in claim 6, wherein said coupling rod is mounted slidably to said outer casing, said positioning unit including:

a push button mounted on said outer casing and having an actuating rod that extends into said outer casing;

a push member mounted slidably in said outer casing and having one end abutting against said actuating rod and an opposite end abutting against said coupling rod; and a retaining unit provided on said outer casing and said push member for retaining said push member in a pushing position, where said push member pushes said coupling rod and said inner body against the action of said biasing spring such that said locking unit locks said inner body to said outer casing, when said push button is operated for a first time, and for retaining said push member in a releasing position, where said biasing spring expands such that said locking unit unlocks said inner body from said outer casing, when said push button is operated for a second time.

8. The self-propelling rolling toy as claimed in claim 1, further comprising a rotary knob mounted on said operating end of said transmission shaft outside said outer casing.

* * * * *